US005945783A

United States Patent [19]

Schultz et al.

[11] Patent Number: 5,945,783

[45] Date of Patent: Aug. 31, 1999

[54] ZERO ENERGY-STORAGE BALLAST FOR COMPACT FLUORESCENT LAMPS

[75] Inventors: William Newell Schultz, Niskayuna; Robert James Thomas, Rexford, both of N.Y.

[73] Assignee: General Electric Company, Schenectady, N.Y.

[21] Appl. No.: 09/114,617

[22] Filed: Jul. 13, 1998

[51] Int. Cl.[6] ..... H05B 37/02

[52] U.S. Cl. ..... 315/219; 315/224; 315/291

[58] Field of Search ..... 315/209 R, 224, 315/219, DIG. 5, 291

[56] References Cited

U.S. PATENT DOCUMENTS 4,544,863 10/1985 Hashimoto ..... 315/209 R

*Primary Examiner*—David H. Vu

*Attorney, Agent, or Firm*—Jill M. Breedlove; Douglas E. Stoner

[57] ABSTRACT

A CFL ballast includes complementary-type switching devices connected in series with their gates connected together at a control node. The switching devices supply a resonant tank circuit which is tuned to a frequency near, but slightly lower than, the resonant frequency of a resonant control circuit. As a result, the tank circuit restarts oscillations immediately following each zero crossing of the bus voltage. Such rapid restarts avoid undesirable flickering while maintaining the operational advantages and high efficacy of the CFL ballast.

7 Claims, 2 Drawing Sheets

ZERO ENERGY-STORAGE BALLAST FOR COMPACT FLUORESCENT LAMPS

The U.S. government has rights in this invention pursuant to Contract No. DE-FC36-97GO10236 awarded by the Department of Energy.

BACKGROUND OF THE INVENTION

The present invention relates generally to lamp ballasts and, more particularly, to a ballast for a compact fluorescent lamp (CFL).

Conventional CFL ballasts employ an uncontrolled rectifier and an electrolytic storage capacitor for providing a stable dc bus for operating a high frequency oscillator. The oscillator provides a high-frequency, nearly sinusoidal current to the lamp. High-frequency operation results in higher lamp efficacy, and high-frequency electronic ballasts are typically smaller and lighter than typical line-frequency ballasts. Disadvantageously, the electrolytic capacitor is one of the most expensive and least reliable components of the lamp ballast; and without power factor correction circuits, the electrolytic capacitor may cause a highly distorted input ballast current. Removing the electrolytic storage capacitor from a conventional high-frequency electronic ballast will result in a circuit that must be restarted after each zero-crossing of the line voltage. The restart must occur at a sufficiently low voltage such that the lamp is driven for the majority of each line cycle. If the restart is slow, such as the restart provided by conventional start-up circuits, the lamp will remain off for a large portion of each line cycle, and flickering and reduced light output will result.

Therefore, it is desirable to provide an electronic CFL ballast which provides high efficacy and flicker-free operation, but does not require an electrolytic storage capacitor or power factor correction circuitry.

SUMMARY OF THE INVENTION

A discharge lamp ballast suitable for a CFL comprises complementary-type switching devices connected in series at a common node and further having their gates connected together at a control node. The switching devices comprise an inverter for converting dc current from an input rectifier to ac current for supplying a resonant tank circuit. The resonant tank circuit comprises a resonant capacitor, a resonant inductor, and the CFL. A resonant control circuit for controlling the switching devices comprises an inductance, a series capacitance and a parallel capacitance connected between the control node and the common node.

The resonant tank circuit is tuned to a frequency near, but slightly lower than, the resonant frequency of the resonant control circuit. With the resonant frequencies of the two circuits sufficiently close, the impedance from source to gate multiplied by the transconductance of the switches is greater than unity, and the circuit restarts oscillations immediately following each zero crossing of the bus voltage. Such rapid restarts avoid undesirable flickering while maintaining the operational advantages and high efficacy of the CFL ballast.

DETAILED DESCRIPTION OF THE INVENTION

Figure 1:
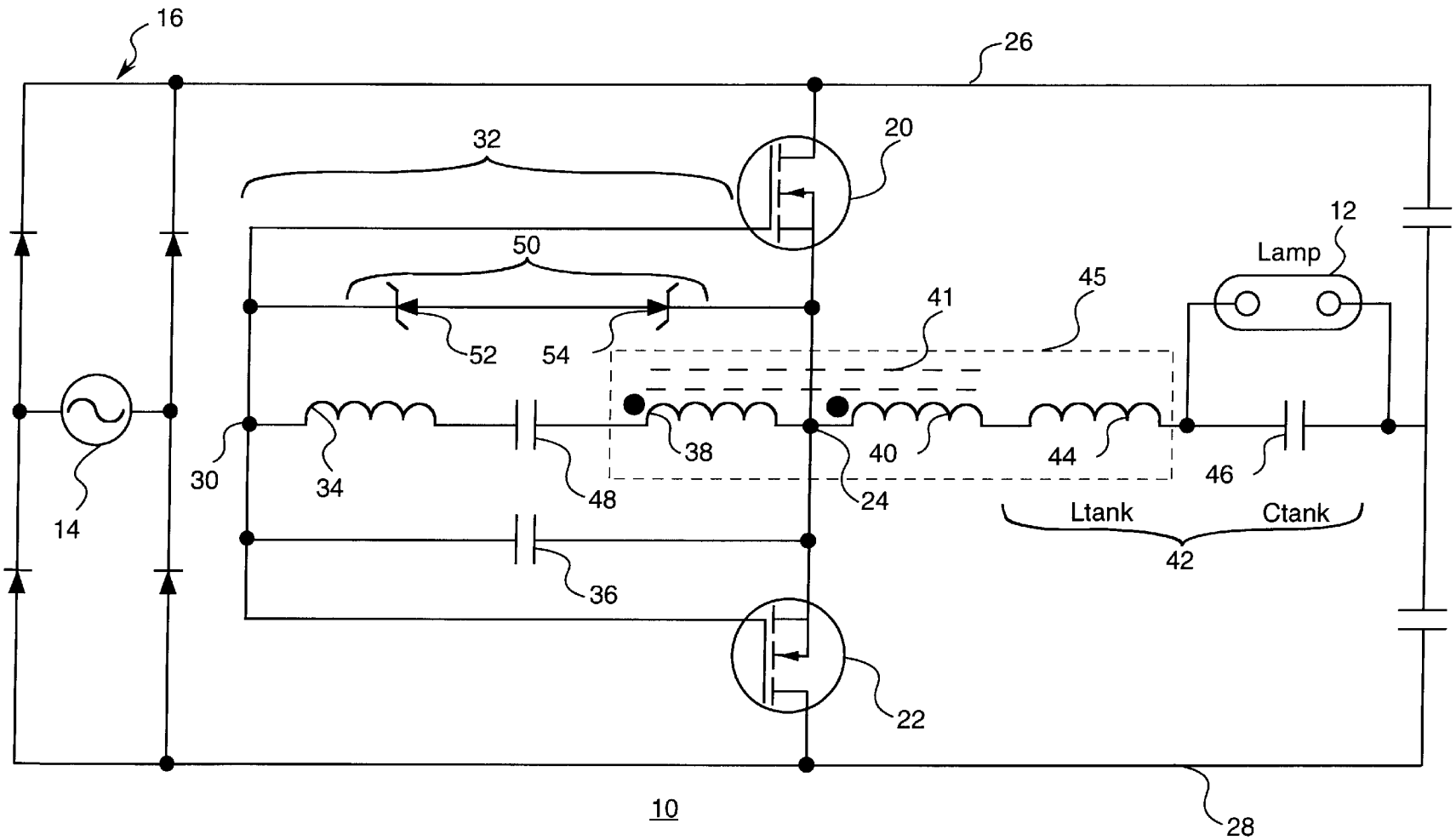
FIG. 1 schematically illustrates a discharge lamp ballast in accordance with preferred embodiments of the present invention; and FIG.'s 2, 3, and 4 graphically illustrate dc bus voltage, lamp current, and lamp voltage for the ballast of FIG. 1.
Figure 2:
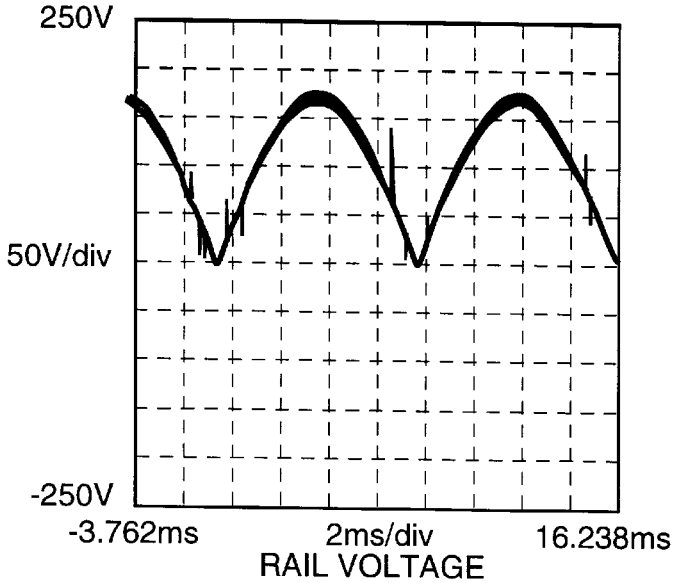
Figure 3:
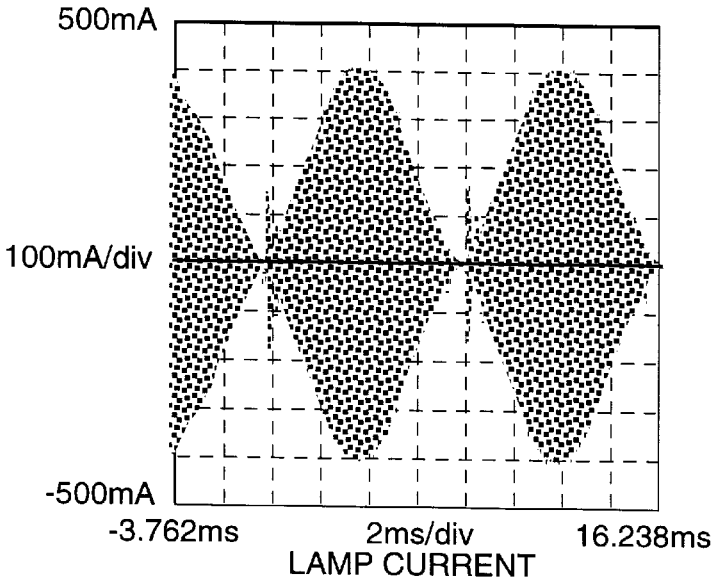

FIG. 1 schematically illustrates a ballast 10 for providing power to operate a discharge lamp 12, such as a CFL, for example. An ac source 14 supplies current to a rectifier 16, which is illustrated as comprising a full-bridge rectifier. Switching devices 20 and 22 are connected in series with each other with a common node 24, the series combination of switching devices being connected in parallel with rectifier 16 between relatively positive and negative voltage buses 26 and 28, respectively. The switching devices are illustrated as comprising FET's, but may comprise any suitable type of switching device.

The gates of switching devices 20 and 22 are connected together at a control node 30. As illustrated, switching devices 20 and 22 comprise complementary-type devices; that is, one is an n-channel enhancement mode device, and the other is a p-channel enhancement mode device. In the illustrated circuit, device 22 is shown as comprising a p-channel device, and device 20 is shown as comprising an n-channel device. The drain of device 20 is connected to voltage bus 26, and the drain of device 22 is connected to voltage bus 28.

A resonant control circuit 32 is connected between control node 30 and common node 24. The resonant control circuit comprises a resonant control inductance 34 and a resonant control capacitance 36. The control capacitance limits the rate of change of gate-to-source voltage between nodes 24 and 30. The control capacitance, therefore, may be used to ensure a dead time between switching of devices 20 and 22, for example. The resonant control circuit further comprises a driving inductance 38 connected in series between control inductance 34 and common node 24. Driving inductance 38 provides the driving energy for operation of the resonant control circuit 32. As shown, the driving inductance 38 may comprise a secondary winding on a transformer 41, the primary winding of which comprises an inductance 40 connected in series with a resonant tank circuit 42. Inductances 38, 40, and 44 may comprise one magnetic structure 45. In particular, windings 38 and 40 comprise the windings of transformer 41, and winding 44 represents the self-inductance of the primary winding of transformer 41.

The resonant tank circuit comprises a tank inductance 44, a tank capacitance 46, and lamp 12. In the illustrated embodiment, the resonant capacitance and resonant inductance are connected in series with each other, and the lamp is connected in parallel with the resonant capacitance, but other resonant circuit configurations may be suitable.

A bi-directional voltage clamp 50 is connected between common node 24 and control node 30 for clamping positive and negative excursions of gate-to-source voltage to predetermined voltage levels. Clamp 50 is shown as comprising back-to-back Zener diodes 52 and 54.

In accordance with preferred embodiments of the present invention, the ballast tank circuit is tuned to a frequency near, but slightly lower than, the resonant frequency of the resonant control circuit. With the resonant frequencies of the two circuits sufficiently close, the impedance from source to gate multiplied by the transconductance of the switches is greater than unity, and the circuit restarts oscillations as soon as the bus voltage 26 rises more than a few volts above zero. By thus restarting the ballast immediately after each zero crossing of the bus voltage, an electrolytic storage capacitor between the dc buses is not needed, and at the same time the performance penalties resulting from the use of start-up circuitry with relatively long delays are avoided.

As shown, control circuit 32 further preferably comprises a dc blocking capacitance 48 coupled in series with control inductance 34. As the circuit oscillates, the voltage on dc blocking capacitance 48 is driven initially positive and then negative as switching devices 20 and 22 are alternately turned on. When the line voltage drops below the level at which the inverter can operate, the voltage on capacitance 48 will be just below the threshold, or turn-on voltage, of device 20 or 22. This residual charge sets the transconductance of the switches on restart.

An additional advantage of the zero energy-storage ballast according to the present invention is greatly reduced input current distortion. By eliminating the electrolytic storage capacitor, the peak charging behavior of such a capacitor is also eliminated. As a result, the input current waveform improves from a short, high current pulse to approximately a square wave.

Figure 4:
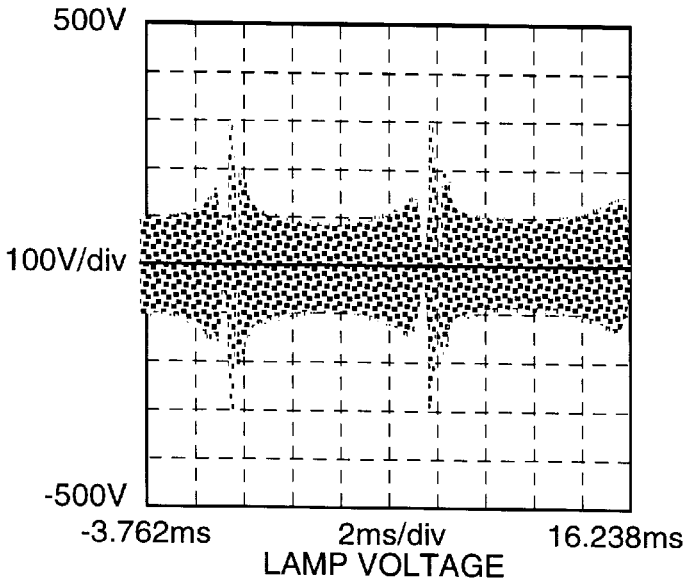

An exemplary 15/20 Watt ballast for operating a 15 Watt hexagonal CFL was configured as in FIG. 1 for zero energy-storage operation with the following component values: 620 $\mu$H control inductance, 4.7 nF control capacitance, 0.1 $\mu$F series capacitance, 600 $\mu$H tank inductance, 6.6 nF tank capacitance. The input voltage, lamp current, and lamp voltage are illustrated in FIG.'s 2, 3, and 4, respectively. With the component values set forth hereinabove, oscillations restart at very low line voltages, and the lamp current is zero for only a small fraction of one millisecond. FIG. 4 shows that only a 300 volt spike is required to restart the lamp under these conditions.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A ballast for a discharge lamp, comprising:

an input rectifier for converting current from an ac source to dc;

a half-bridge inverter coupled between voltage buses for receiving dc current from the input rectifier, the inverter comprising two complementary-type switching devices connected together at a common node and further having the gates of the switching devices connected together at a control node;

a resonant control circuit coupled to the control node, the resonant control circuit comprising a control capacitance and a control inductance;

a resonant tank circuit coupled to the inverter and comprising a tank inductance, a tank capacitance, and the lamp, the resonant tank circuit being tuned to a frequency slightly lower than the resonant frequency of the resonant control circuit such that the circuit impedance between the control node and the common node multiplied by the transconductance of the switching devices is greater than unity.

2. The ballast of claim 1, further comprising a clamp coupled between the control node and the common node for clamping positive and negative excursions of gate-to-source voltage of the switching devices to predetermined voltage levels.

3. The ballast of claim 2 wherein the clamp comprises a pair of Zener diodes connected in series with opposite polarity.

4. The ballast of claim 1 wherein the tank inductance and tank capacitance are coupled in series, the tank capacitance being coupled in parallel with the lamp.

5. The ballast of claim 1 wherein the resonant control circuit further comprises a secondary winding of a driving transformer, the tank inductance and driving transformer comprising a single, two-winding magnetic structure.

6. The ballast of claim 1 wherein the control capacitance has a capacitance value which provides a dead time between switching of the switching devices.

7. The ballast of claim 1 wherein the resonant control circuit further comprises a dc blocking capacitance coupled in series with the control inductance.

* * * * *